US008037567B1

(12) United States Patent
Harris

(10) Patent No.: US 8,037,567 B1
(45) Date of Patent: Oct. 18, 2011

(54) HYDRO TURBO CLEAN POWER WASHER

(76) Inventor: Lee Harris, Lincolnwood, IL (US)

( * ) Notice: Subject to any disclaimer, the term of this patent is extended or adjusted under 35 U.S.C. 154(b) by 208 days.

(21) Appl. No.: 12/413,183

(22) Filed: Mar. 27, 2009

(51) Int. Cl.
*A46B 13/06* (2006.01)
*B24B 47/14* (2006.01)

(52) U.S. Cl. ..... 15/24; 15/29; 15/69; 15/104.12; 415/81; 415/904; 451/295

(58) Field of Classification Search ..... 15/24, 29, 15/69, 104.12, 387; 415/63, 81, 903, 904; 433/132; 451/27, 61, 295, 466
See application file for complete search history.

(56) References Cited

U.S. PATENT DOCUMENTS

| | | | | | |
|---|---|---|---|---|---|
| 1,208,713 | A | * | 12/1916 | Roland | 15/24 |
| 1,372,308 | A | * | 3/1921 | Macrae | 15/29 |
| 1,471,748 | A | * | 10/1923 | Miller | 15/24 |
| 1,580,294 | A | * | 4/1926 | Gawley | 15/104.066 |
| 2,506,487 | A | * | 5/1950 | Burns | 15/24 |
| 3,872,533 | A | * | 3/1975 | Proffit | 15/1.7 |

* cited by examiner

*Primary Examiner* — Mark Spisich
(74) *Attorney, Agent, or Firm* — Adam Sacharoff

(57) ABSTRACT

A rotary elliptically shaped head, free spinning, designed to be attached to a pressurized hose, fluid driven. When activated, the fluid is directed thru the head, striking internal longitudinal fins the cause the had to spin longitudinally, at high speed. The fluid is released thru holes in the head, which by the same centrifugal force driving the head along rows of bristles. When applied to a desire surface the head will scrub and clean the surface.

1 Claim, 4 Drawing Sheets

HYDRO TURBO CLEAN POWER WASHER

FIELD OF THE INVENTION

The field of the invention relates to an apparatus for cleaning, sanding, grinding, cutting & polishing surfaces.

BACKGROUND OF THE INVENTION

The prior inventions directed to clean, sand, grind, cut & polish, have had a more labor intensive process, as well as more complicated procedures. For example, U.S. Pat. No. 5,235,717 to Lanzo, Jr. is directed to a liquid driven ball, set at a perpendicular angle and attached to a wand with the liquid flowing thru a mesh and porous foam material. U.S. Pat. No. 3,731,334 to Carbonell, sets forth a scrubber utilizing a motor powered rotary brush structure. U.S. Pat. No. 4,686,729 to Roman sets forth a scrubber having rotary blades mounted within a housing in fluid communication with a conduit as the individual matrix rotary brushes are mounted medially of a bottom wall of the housing. Accordingly, it may be appreciated there continues to be a need for a need for a new & improved rotary scrubber apparatus as set forth by the instant invention addressing both the problems of ease of use, as well as effectiveness in construction, durability, effecting the rotary cleaning of surfaces. The present invention substantially fulfills this need.

SUMMARY OF THE INVENTION

In view of the foregoing disadvantages inherent in the known types of scrubber apparatus now present in the prior art, the present invention provides a rotary scrubber apparatus wherein the same utilizes pressured liquid to effect rotary displacement of find longitudinally molded into the power washer head. As such, the general purpose of the present invention, which will be subsequently described in greater detail, is to provide a new and improved rotary scrubber which has all of the advantages of the prior art scrubber apparatus, and none of the disadvantages.

To attain this, the present invention provides a longitudinally scrubber, formed of a one piece injected material (durable polystrurene, or plastic), with the longitudinal fins a part of this same material and injected process, and holes throughout the head allowing the liquid to run from the interior of the head to the outside, by centrifugal force. The head design, both by its longitudinal design and durable materials will markedly enhance its cleaning ability, access of surfaces, and length of service.

Numerous advantages and features of the invention will become readily apparent from the following detailed description of the invention and the embodiments thereof, and from the accompanying drawings.

BRIEF DESCRIPTION OF THE DRAWINGS

A fuller understanding of the foregoing may be had by reference to the accompanying drawings, wherein.

DESCRIPTION OF THE DRAWINGS

Figure 1:
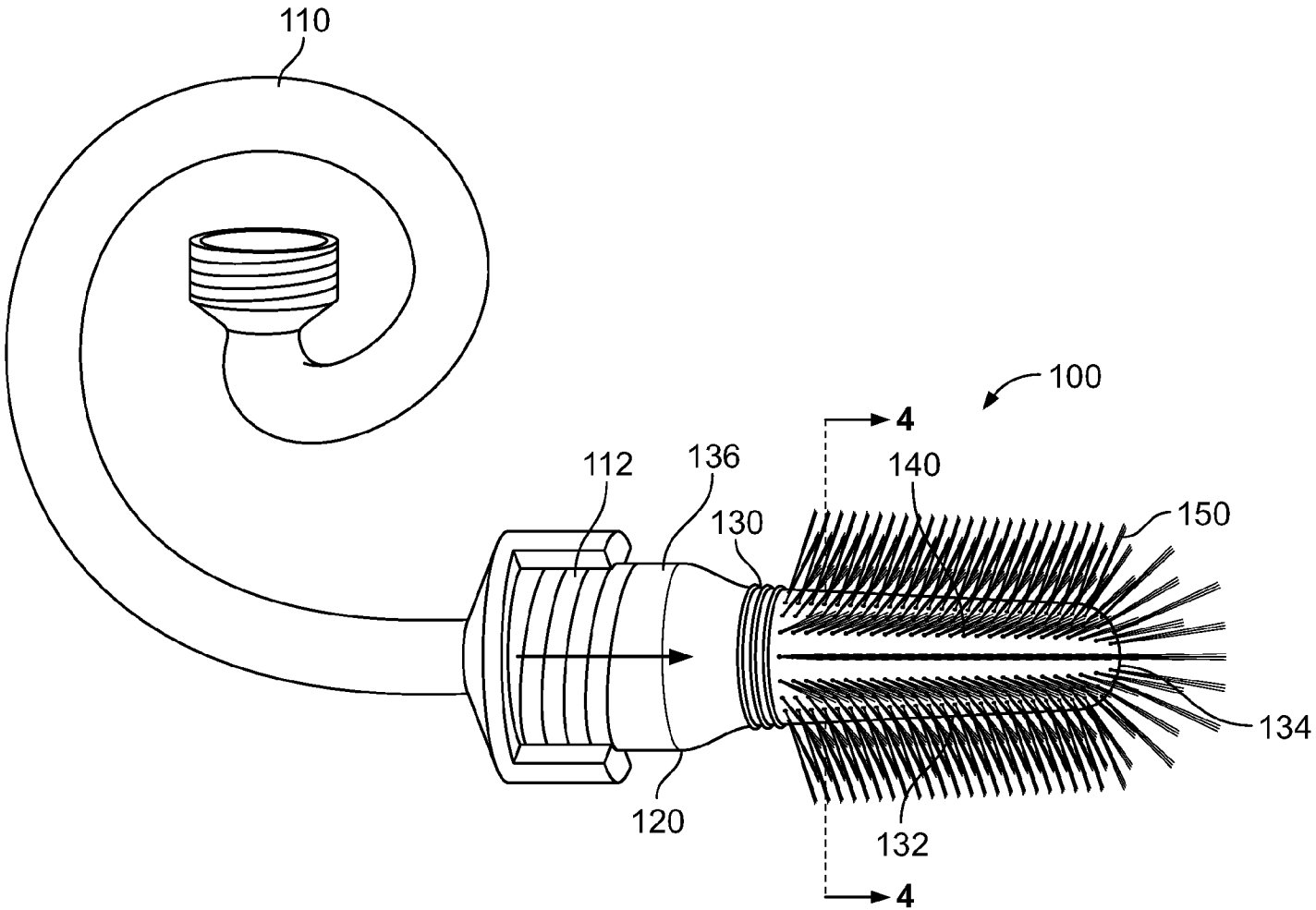
FIG. 1 is a perspective view of a hydro power scrubber in accordance to one embodiment of the present invention.

While the invention is susceptible to embodiments in many different forms, there are shown in the drawings and will described herein, in detail, the preferred embodiments of the present invention. It should be understood, however, that the present disclosure is to be considered an exemplification of the principles of the invention and is not intended to limit the spirit or scope of the invention, claims and/or embodiments illustrated.

Referring now to FIG. 1, there is disclosed one embodiment of the present invention, illustrated from an exterior view of the power scrubber 100. The power scrubber 100 is attached to a pressurized fluid source 110, such as but not limited to a power washer and even in some circumstances a water hose. The power scrubber 100 is secured to the pressurized fluid source 110 by a threaded section 112. The head 120 of the power scrubber 100 may be tightened by a molded or fixed exterior part of the head and may be hexagonally shaped. A coupling section 130 is secured along the shaft 132 of the head 120 to permit the top section 134 to rotate freely and independently from the base section 136. The coupling section may include an O ring or other means to prevent the fluid from leaking. The head 120 includes a plurality of perforations 140 or openings from the interior section (not shown) to the exterior, allowing the fluid from the power washer to flow out from the head 120. Lastly, a plurality of bristles 150, are placed about the head, allowing the fluid to run along the bristles as the entire head spins at a head speed.

Figure 2:
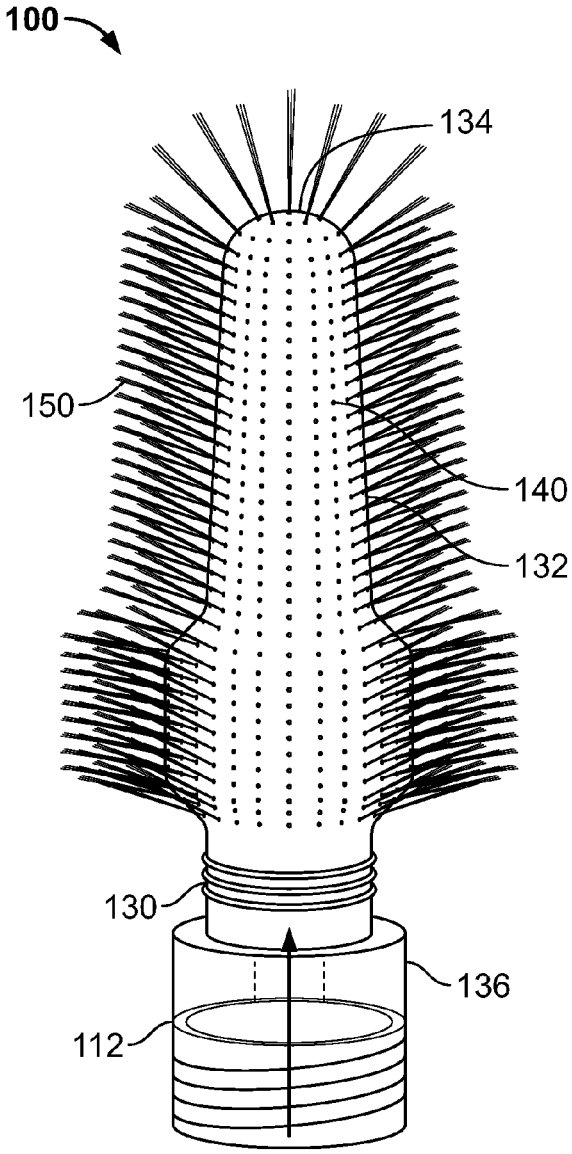
FIG. 2 is a front perspective view of the scrubber from FIG. 1.

FIG. 2 is a closer view of the power scrubber 100 from FIG. 1.

Figure 3:
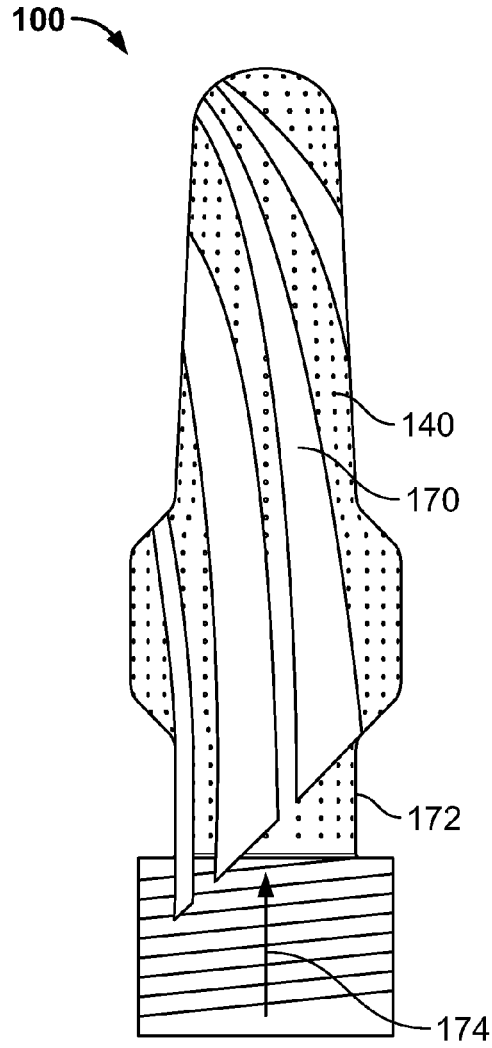
FIG. 3 is interior sectional view of the power scrubber from FIG. 1.

FIG. 3 is an interior sectional view of the power scrubber from FIG. 1. The interior section 160 of the power scrubber 100 includes longitudinal fins 170 molded into the inside wall 172 of the head 120. The fins 170 may be arranged in various configurations, however, the present invention as arranged the fins in a spiral direction, such that the fluid traveling into the power scrubber 100 (indicated as arrow 174) will strike the fins causing the head 120 to spin at a high speed, with the water forced out through the openings 140 by centrifugal force.

Figure 4:
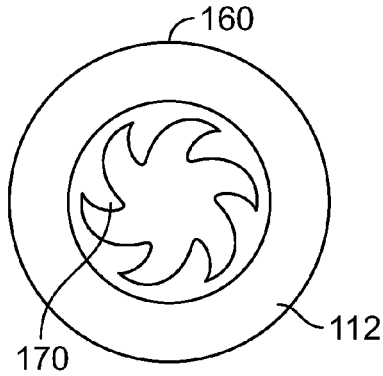
FIG. 4 is a cross sectional view of the power scrubber from FIG. 1.

FIG. 4 is an interior cross sectional view of the power scrubber 100 from FIG. 3.

The unique combination of a free spinning, liquid driven power head has numerous commercial, industrial and consumer applications, when different surfaces, textures and materials are applied.

Figure 5A:
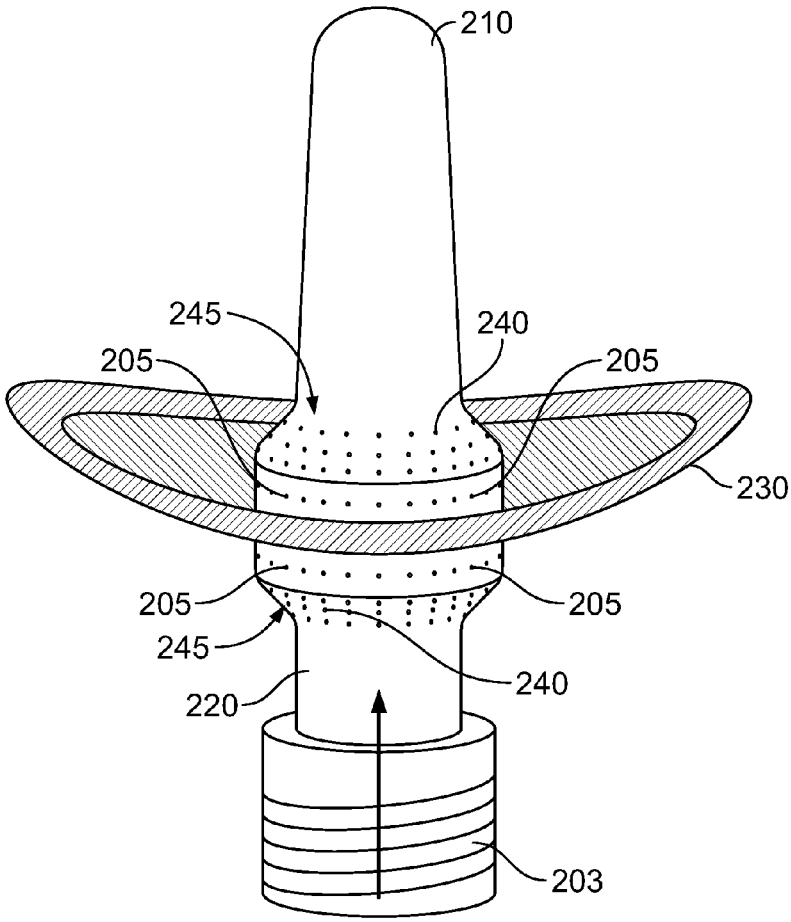
FIG. 5*a* is a perspective view of a hydro power cutter in accordance to one embodiment of the present invention.
Figure 5B:
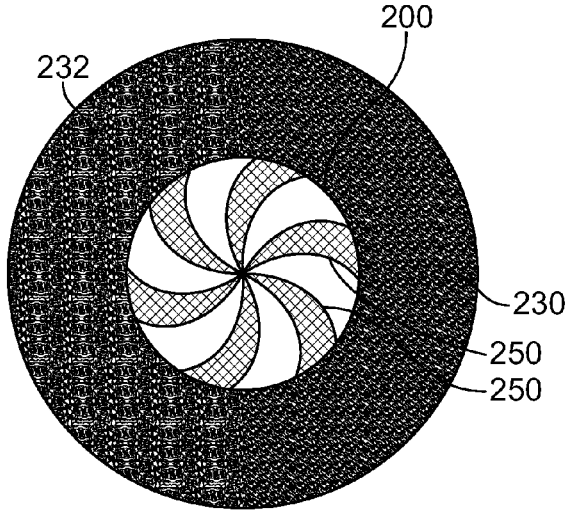
FIG. 5*b* is a cross sectional view of the hydro power cutter from FIG. 5*a*.

Referring now to FIGS. 5*a* and 5*b*, in another embodiment, the power head 200 includes a threaded base 203 to attach to the pressurized fluid source and includes a male/female threaded fittings 205 that allow the top portion 210 to be unscrewed from the base portion 220. A cutting or grinding plate 230 can be removably inserted between the threaded fittings 205. The perforations 240 on the head 200 are dispersed in a region 245 only about the threaded fittings 205 to cause the liquid to spin out to the surface by centrifugal force such that the liquid both cleans and cools the surface of the blade spinning. Applications including cutting, grinding, and polishing and depending on the material and coarseness of the material various grade or setting can be achieved. For example, the blade can be used to cut thru masonry or masonry joints or cut glass or metal or alternatively polish these materials.

In FIG. 5*b*, a cross section view of the power head 200 viewed from a top perspective, shows the fins 250 lying at a right angle to the fluid entering the power head 200. The coupling sections or threaded fittings 205 spin freely as a single unit when the sanding or cutting blade is inserted between the fittings 205. The fins 250 are pitched slightly to cause the head to spin at a high speed and to angle the water coming off the fins to exit on either side of the plate 230 via the perforations 240. The surface of the plate 232 may be coated on either one or both sides with various abrasive materials, such as but not limited to diamond dust, sand grit, etc.

Figure 6:
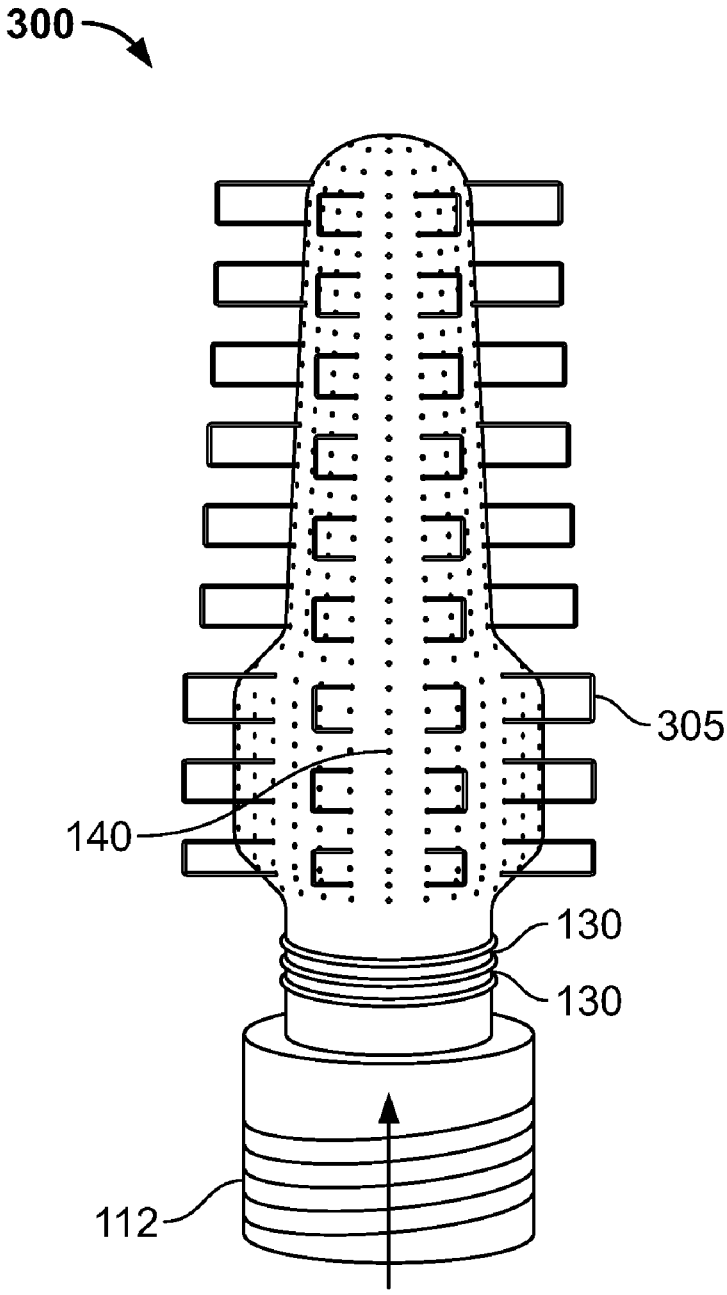
FIG. 6 is a perspective view of a hydro power scrubber in accordance to another embodiment of the present invention.

Referring now to FIG. 6 in another embodiment of the present invention, the power head 300 is similar to the power scrubber 100 in FIG. 1, except that the power head 300 includes flaps 305 rather then bristles. The flaps 305 are a durable rubber material that may be coated with a sanding or polishing material. As the head spins the flaps 305 with the sanding or polishing material brushes across a surface such that the surface is sanded or polished.

From the foregoing and as mentioned above, it will be observed that numerous variations and modifications may be effected without departing from the spirit and scope of the novel concept of the invention. It is to be understood that no limitation with respect to the specific methods and apparatus illustrated herein is intended or should be inferred. It is, of course, intended to cover all such modifications.

I claim:

1. A power scrubber comprising:

a body having a base section, an elongated head section and a coupling section intermediate the base section and the head section, at least the head section having a substantially hollow interior section;

the base section having a threaded section adapted for securing the base section to a power washer;

the coupling section securing the base section to the head section such that the head section rotates freely and independently of the base section;

the head section including a plurality of openings connecting an inner surface of the interior section with an outer surface;

a plurality of bristles attached about the head section; and at least one elongated fin within the interior section of the head section and secured to the inner surface thereof, the elongated fin having a spiral configuration and extending along substantially the entire length of the head section, wherein a fluid traveling into the interior section from the power washer interacts with the elongated fin to rotate the head section and the fluid ejects from the plurality of openings.

* * * * *